US008020319B1

(12) United States Patent
Mohaupt

(10) Patent No.: US 8,020,319 B1
(45) Date of Patent: Sep. 20, 2011

(54) SHOE WITH ELASTIC BINDINGS TO RECEIVE INTERCHANGEABLE STRAPS

(76) Inventor: Anne Elizabeth Mohaupt, Chicago, IL (US)

( * ) Notice: Subject to any disclaimer, the term of this patent is extended or adjusted under 35 U.S.C. 154(b) by 1016 days.

(21) Appl. No.: 11/605,123

(22) Filed: Nov. 28, 2006

Related U.S. Application Data

(60) Provisional application No. 60/740,321, filed on Nov. 29, 2005.

(51) Int. Cl.
*A43B 3/24* (2006.01)
*A43B 11/00* (2006.01)
*A43B 13/08* (2006.01)
*A43B 3/12* (2006.01)

(52) U.S. Cl. ..... 36/101; 36/51; 36/11.5; 36/33

(58) Field of Classification Search ..... 36/50.1, 36/51, 100, 101, 102, 106, 11.5, 33; D2/916, D2/918
See application file for complete search history.

(56) References Cited

U.S. PATENT DOCUMENTS

| | | | | | |
|---|---|---|---|---|---|
| 2,153,968 | A | | 4/1939 | Loutbahn | |
| 2,173,702 | A | * | 9/1939 | Winkel | 36/11.5 |
| 2,368,314 | A | | 1/1945 | Marx | |
| 2,469,708 | A | * | 5/1949 | Alexander | 36/11.5 |
| 2,526,940 | A | * | 10/1950 | Fello | 36/11.5 |
| 2,551,723 | A | * | 5/1951 | Camero | 36/11.5 |
| 2,761,224 | A | | 9/1956 | Garland | |
| 2,976,623 | A | | 3/1961 | Gallaway | |
| 3,121,962 | A | * | 2/1964 | Gullo | 36/11.5 |
| 3,154,866 | A | | 11/1964 | Loutbahn | |
| 3,204,346 | A | | 9/1965 | Lockard et al. | |
| 3,800,444 | A | * | 4/1974 | Young | 36/11.5 |
| 3,983,642 | A | * | 10/1976 | Liao | 36/101 |
| 4,297,798 | A | | 11/1981 | Colan | |
| 4,450,633 | A | | 5/1984 | Connelly | |
| 4,461,102 | A | | 7/1984 | DeVincentis | |
| 5,640,785 | A | * | 6/1997 | Egelja | 36/50.1 |
| 5,692,319 | A | * | 12/1997 | Parker et al. | 36/50.1 |
| 5,992,058 | A | | 11/1999 | Jneid | |
| 6,029,376 | A | * | 2/2000 | Cass | 36/50.1 |
| 6,052,921 | A | * | 4/2000 | Oreck | 36/50.1 |
| 6,128,834 | A | | 10/2000 | Vecchiola et al. | |
| 6,499,234 | B2 | | 12/2002 | Manzi | |
| 6,651,359 | B1 | | 11/2003 | Bricker | |
| 6,772,539 | B1 | * | 8/2004 | Tai | 36/11.5 |
| 6,792,696 | B2 | | 9/2004 | Berg et al. | |
| 6,928,754 | B2 | | 8/2005 | Cambronero | |
| 2005/0081403 | A1 | * | 4/2005 | Mathieu | 36/50.1 |
| 2006/0026861 | A1 | * | 2/2006 | Manzi | 36/11.5 |
| 2006/0283042 | A1 | * | 12/2006 | Greene et al. | 36/3 A |

OTHER PUBLICATIONS http://www.touchups.com/newPop.php?id=632.

* cited by examiner

*Primary Examiner* — Jila M Mohandesi
*Assistant Examiner* — Melissa L Lalli
(74) *Attorney, Agent, or Firm* — Erickson Law Group, PC

(57) ABSTRACT

An interchangeable shoe strap system that permits the user to customize the fit and aesthetics of her footwear. The shoe includes a sole member 22 with an upper surface 24 to support a wearer's foot and a lower surface 26 to contact a support surface. An elastic binding 28 is affixed to a sole member 22 with a series of knots 36 and mounting studs 30, thusly creating loops in the elastic binding 28. An equal number of loops, of a substantially equal size, are aligned transversely along the side edges of the forward region of the shoe sole member 22. The shoe is completed when the wearer laces a strap 34 through the elastic bindings 28.

19 Claims, 5 Drawing Sheets

SHOE WITH ELASTIC BINDINGS TO RECEIVE INTERCHANGEABLE STRAPS

CROSS-REFERENCE TO RELATED APPLICATIONS

This application claims the benefit of provisional patent application Ser. No. 60/740,321, filed 2005 Nov. 29 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention generally relates to footwear, specifically to a shoe with interchangeable straps to allow functional and aesthetic changes to the shoe.

2. Prior Art

Fashion conscious consumers are commonly concerned with coordinating their footwear with their attire. This often results in a large shoe wardrobe, which can be a financial burden, a storage inconvenience, and whose manufacture can tax the environment. Additionally, "strappy" sandals and other fashionable footwear are usually created in standard, fixed sizes and shapes, and do not provide a way for individuals to create a comfortable, custom fit.

Previously, inventors have created several types of shoes with interchangeable uppers/straps to allow alterations in the appearance and/or function of the footwear. Prior attempts have not provided a system for the wearer to easily and inexpensively create, in almost limitless variety, shoes of varying fit and appearance, while providing a resilient, flexible fit while walking.

U.S. Pat. No. 2,368,314 to Marx (1945); U.S. Pat. No. 2,761,224 to Garland (1956); U.S. Pat. No. 2,976,623 to Gallaway (1961); U.S. Pat. Nos. 2,153,968 (1939) and 3,154,866 (1964) to Loutbahn; U.S. Pat. No. 3,204,346 to Lockard et al. (1965); U.S. Pat. No. 4,450,633 to Connelly (1984); U.S. Pat. No. 4,461,102 to DeVincentis (1984); U.S. Pat. No. 5,992,058 to Jneid (1999); U.S. Pat. No. 6,651,359 to Bricker (2003); and U.S. Pat. No. 6,928,754 B2 to Cambronero (2005) are examples of systems of sandals with interchangeable straps wherein the straps connect to the sole with proprietary hardware connections such as snaps, anchors or other fasteners. These designs require complicated attachments between the straps and the sole, and force the wearer to purchase multiple straps from the manufacturer to create a variety of appearances of the shoe upper. Additionally, these systems do not intrinsically allow the wearer to customize the fit of the shoe or the configuration of the straps.

U.S. Pat. No. 6,128,834 to Vecchiola et al.; and U.S. Pat. No. 6,792,696 to Berg et al. (2004) are systems wherein straps are threaded through transverse slots in the sole of the shoe. These systems require complicated and time-consuming maneuverings to change straps, allow only proprietary straps to couple with the sole, and the strap connection to the shoe is not inherently flexible, resulting in the strap abrading against the shoe sole and/or foot while walking.

U.S. Pat. No. 4,297,798 to Colan (1981); U.S. Pat. No. 6,499,234 to Manzi (2002); and the "Lee" style shoe by "Touch Ups" brand allow for a variety of ribbons, laces or other strap-like materials to form the upper, and allow for a variety of configurations of the lacing, but do not provide a flexible connection between the lacing and the shoe sole, resulting in the lacing abrading both against the foot, causing discomfort, and against the shoe sole, causing the lacing to deteriorate quickly.

All shoes with interchangeable uppers heretofore known suffer from one or more of the following disadvantages:

(a) The upper is of a proprietary design that forms a complete shoe only with a coordinating proprietary sole. Therefore, to change the appearance of the shoe upper, the user must go through the expense and inconvenience of purchasing a number of upper components from the manufacturer.

(b) The upper component(s) cannot be re-configured to create alternate arrangements for functional or aesthetic purposes.

(c) Only a limited number of styles or colors of proprietary uppers may be available from a manufacturer, restricting the user's ability to coordinate her shoes with her wardrobe and to truly create a unique custom shoe upper.

(d) Changing the upper requires a confusing and/or complicated connection method, typically employing hardware such as anchors, snaps or other mechanical connections.

(e) Connection methods utilizing a hardware attachment between the upper and sole are prone to damage from wear or user error.

(f) The fit of the upper cannot be customized.

(g) The upper has a static connection to the sole, causing the upper to abrade against the foot and/or against the shoe sole at the attachment point(s).

(h) Changing the upper is complicated and time-consuming, particularly where strap(s) are to be threaded through long, narrow, and/or curving slot(s).

OBJECTS AND ADVANTAGES

Accordingly, several objects and advantages of the invention are:

(a) to provide a shoe with which a user can employ any of a variety of commonly available materials to inexpensively create a new upper as often as she wishes.

(b) to provide a shoe with which the straps that compose the uppers can be arranged in nearly limitless configurations to create functional or aesthetic variations, such as a "mule"/slip-on style, an ankle tie, or laced up the leg.

(c) to provide a shoe with which the user can employ a nearly limitless variety of ribbons, laces, trims, tapes or other materials (referred to as "straps" herein) to create the upper of the shoe.

(d) to provide a shoe where the connection method between the interchangeable upper and sole is simple and obvious to an inexperienced user.

(e) to provide a shoe where the physical connection between the interchangeable upper and sole is sturdy and dependable.

(f) to provide a shoe where the upper can be quickly and easily customized to an ideal fit for the wearer.

(g) to provide a shoe where the physical connection between the interchangeable upper and sole is flexible, in order to provide a more comfortable walking experience.

(h) to provide a shoe with which the upper can be changed quickly.

Further objects and advantages are to provide a shoe with interchangeable uppers that a user can easily match to her attire, which are appropriate for travelers with limited packing space, which cause less environmental damage by reducing a need for a large shoe wardrobe, which easily accommodate wide variations in foot shapes, which provide an opportunity for consumers to essentially design their own shoe uppers, which allow alternatives for vegetarians and others who have personal preferences regarding materials in the upper composition, and which utilizes straps that can be used for other purposes such as belts or hair ties. Still further objects and advantages will become apparent from a consideration of the ensuing description and drawings.

SUMMARY

In accordance with the invention, the shoe includes a sole member with an upper surface for receiving a user's foot and a lower surface for contacting a support surface. The sole member features elastic bindings through which a coupling strap is laced to form the shoe's upper.

DRAWINGS

Figures

In the drawings, closely related figures have the same number but different alphabetic suffixes.

REFERENCE NUMERALS

| | |
|---|---|
| 20 | an embodiment of a shoe according to the present invention |
| 22 | sole member |
| 24 | upper surface of the sole member |
| 26 | lower surface of the sole member |
| 28 | elastic binding |
| 30 | mounting stud |
| 32 | heel |
| 34 | interchangeable strap—general |
| 36 | knot |

-continued

| | |
|---|---|
| 38 | countersunk recess |
| 40 | interchangeable strap—ankle tie |
| 42 | interchangeable straps—triple ties |
| 44 | interchangeable strap—long tie |
| 50 | an example of an alternative embodiment of a shoe according to the present invention |
| 52 | flat sole member |
| 54 | wedge sole member |
| 56 | platform high heeled sole member |
| 60 | sole member of molded material |
| 62 | elastic binding—molded in place |
| 64 | staple |
| 66 | continuous elastic binding |
| 70 | elastic binding—alternative embodiment |
| 72 | hole through sole member |
| 74 | knot |

DETAILED DESCRIPTION

Preferred Embodiment

Figure 1A:
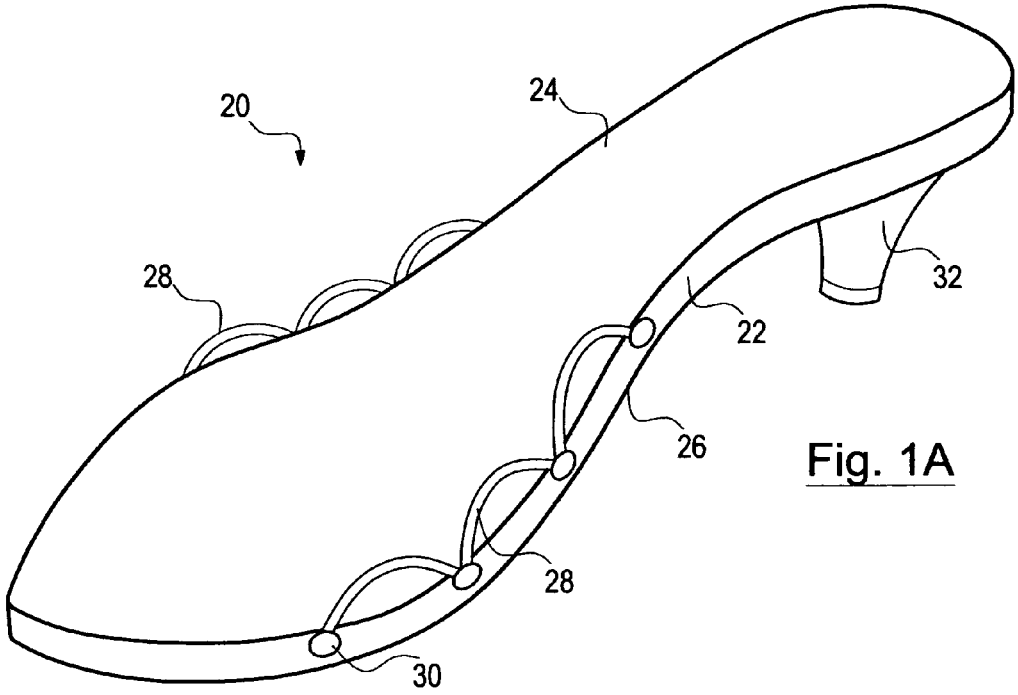
FIG. 1A is a perspective view of an embodiment of a shoe according to the present invention of a sole member featuring elastic bindings to receive interchangeable straps which form the shoe upper.

With reference to the drawings, and in particular to FIGS. 1A (perspective view), 2 (exploded perspective view), 3 (plan view), 4 (front elevational view), 5 (rear elevational view), and 6 (side elevational view) thereof, the preferred embodiment of the shoe system embodying the principle and concepts of the present invention and generally designated by the reference numeral 20 will be described.

Referring to FIG. 1A (perspective view), one embodiment of a shoe according to the present invention is generally shown at 20. The shoe includes a sole member 22 with an upper surface 24 and a lower surface 26. In use, a wearer's foot is placed on the upper surface 24 and the lower surface 26 contacts a support surface, such as a floor or the ground. The sole member 22 is currently preferred to be composed of a rigid material such as wood or acrylic, or a semi-rigid composite material. The upper support surface 24 may be of the same material as the sole member, or may be a padded material as to provide additional comfort to the shoe. The lower surface 26 may be of the same material as the sole member, or may be an alternate rubber-like material as to provide additional resilience, traction and durability to the shoe.

Figure 2:
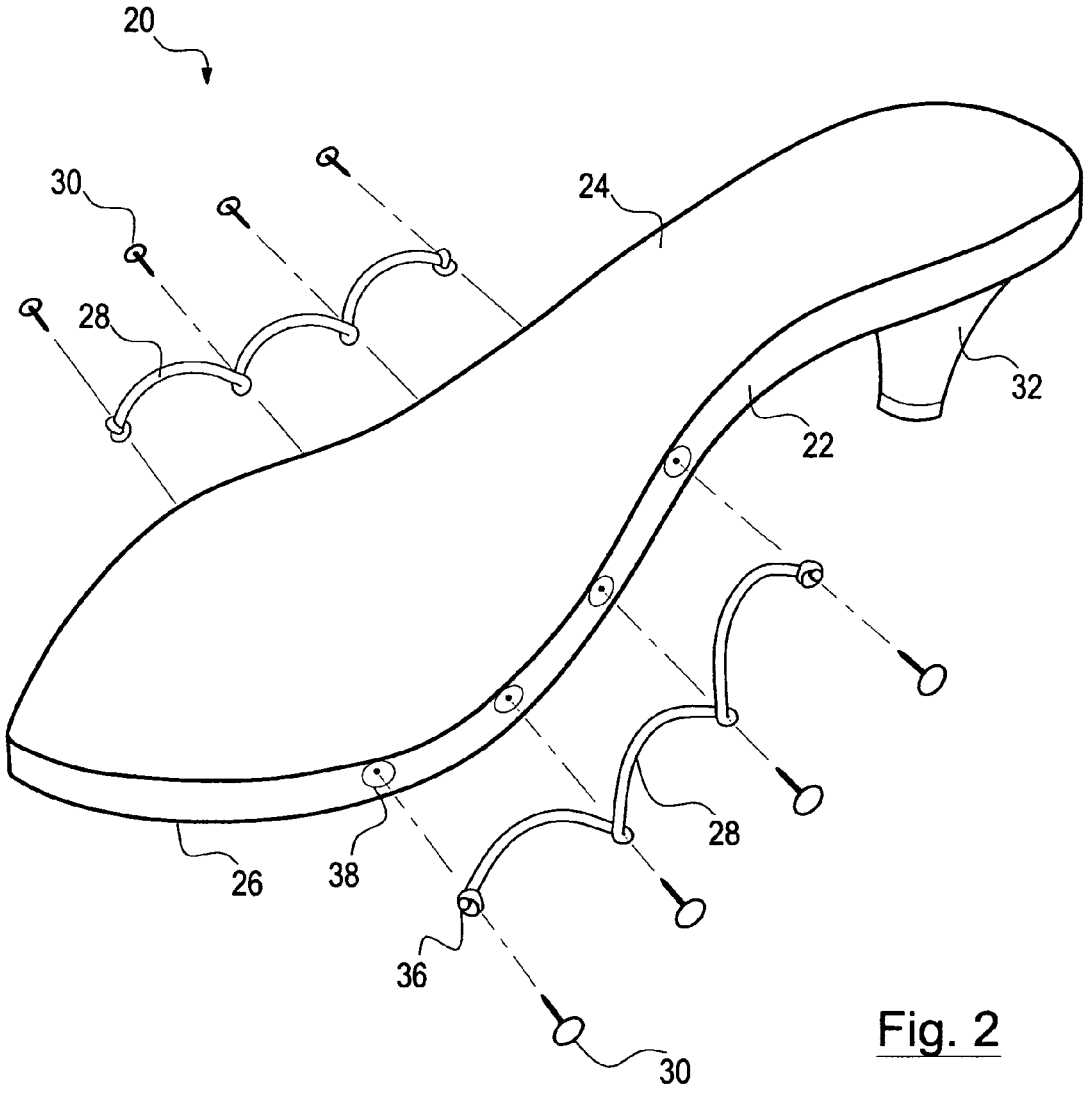
FIG. 2 is an exploded detail view of the shoe of FIG. 1A, showing the physical connection between the elastic bindings and the sole member.

As more particularly shown in FIG. 2, elastic bindings 28 are attached to the sole member 22. The elastic binding may be of any sturdy, resilient, stretchable material such rubber cording encased within a woven protective cover, presently preferred to be an approximately 15 cm length of 3 mm diameter shock cord comprised of an abrasion resistant nylon sheath encasing an aggregation of rubber cords. However, the elastic bindings may consist of any relatively narrow springy material that is sturdy, durable, and abrasion resistant enough to endure the substantial amount of forces that are exerted upon the bindings while walking, yet pliable enough to form small concealable knots when tied tightly.

The elastic binding 28 is tied in a series of loops and/or knots and is attached by with mounting studs 30. A mounting stud 30 is tack, nail, staple or screw which includes a head portion and a penetrating portion. For aesthetic reasons, a sturdy yet decorative upholstery tack is currently preferred, with a 6 mm diameter head that covers the knots formed in the elastic binding, and a minimum 12 mm length on the penetrating portion. In this embodiment, the elastic binding 28 is formed into an assemblage of loops of substantially equal size by creating a series of knots 36 in the binding 28 and driving the mounting stud 30 through the knot 36 and into the side wall of the sole 22. Corresponding countersunk recesses 38 may be formed in the side wall of the sole 22 to receive the knots 36.

Figure 3:
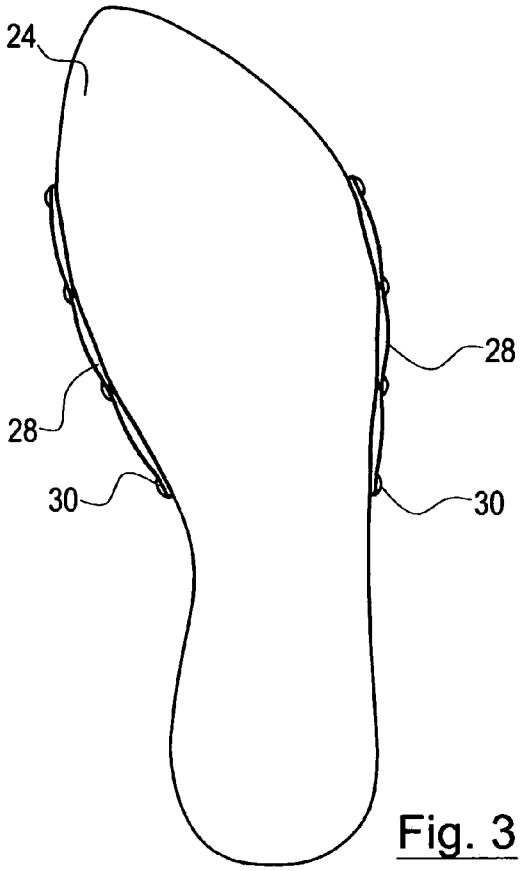
FIG. 3 is a plan view of the shoe of FIG. 1A.
Figure 4:
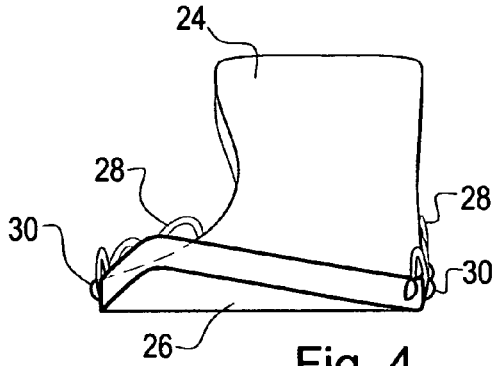
FIG. 4 is a front elevational view of the shoe of FIG. 1A.
Figure 5:
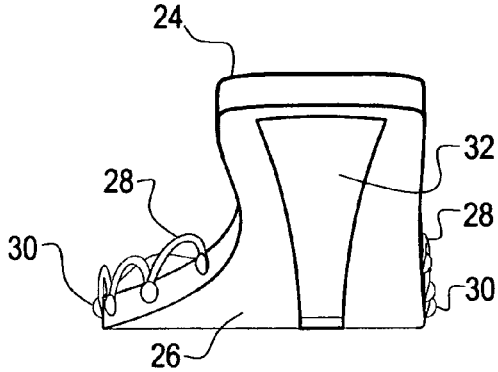
FIG. 5 is a rear elevational view of the shoe of FIG. 1A.
Figure 6:
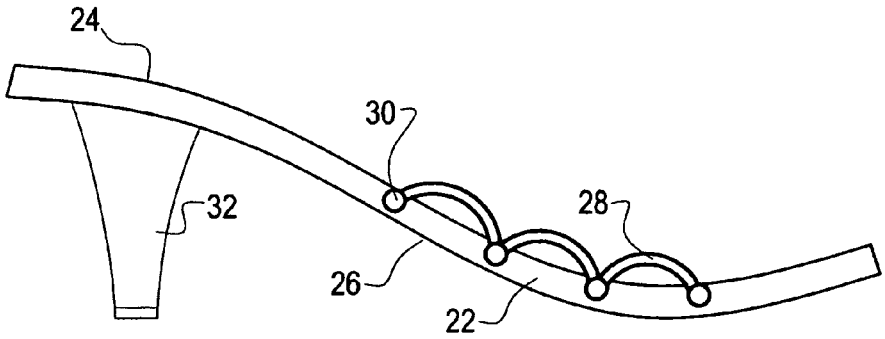
FIG. 6 is a side elevational view of the shoe of FIG. 1A, the opposite side being a mirror image thereof.

As shown if FIG. 3, it is preferred that an equal number of loops, of a substantially equal size, are formed with the elastic bindings 28 and mounting studs 30 on the inner edge and outer edge of the forward region of the shoe sole member 22. These loops generally align transversely to create a balanced, comfortable fit. The shoe is completed when the wearer laces a strap 34 through the elastic bindings 28 as shown in FIG. 1B.

Operation

Preferred Embodiment

Figure 1B:
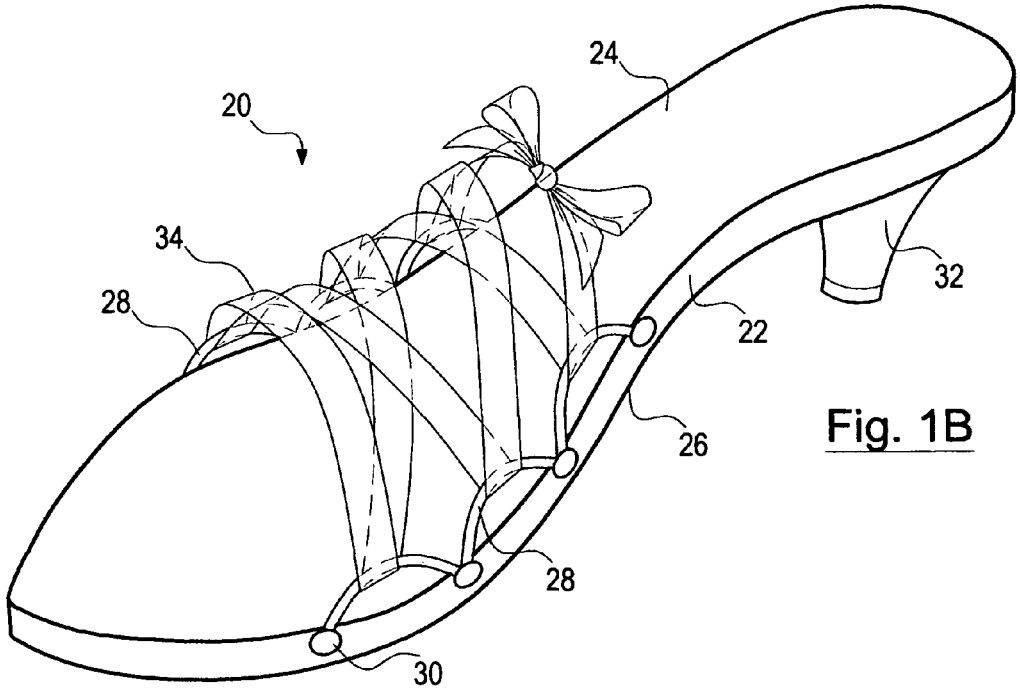
FIG. 1B is a perspective view of the shoe of FIG. 1A, showing a strap laced through the elastic bindings to form the shoe's upper.
Figure 7A:
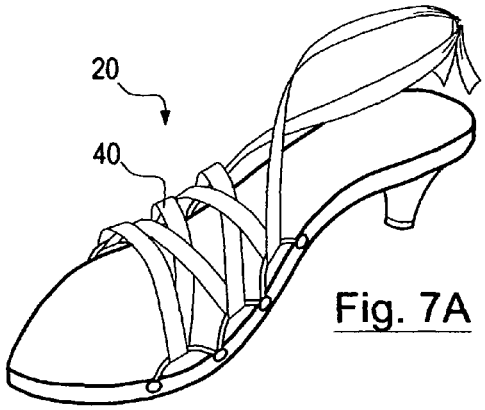
FIGS. 7A to 7C are perspective views of the shoe of FIG. 1B, showing alternate lacing arrangements of the shoe upper.
Figure 7B:
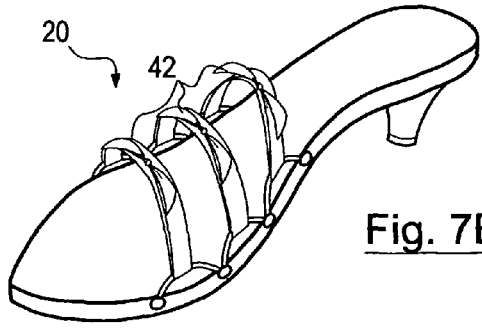
Figure 7C:
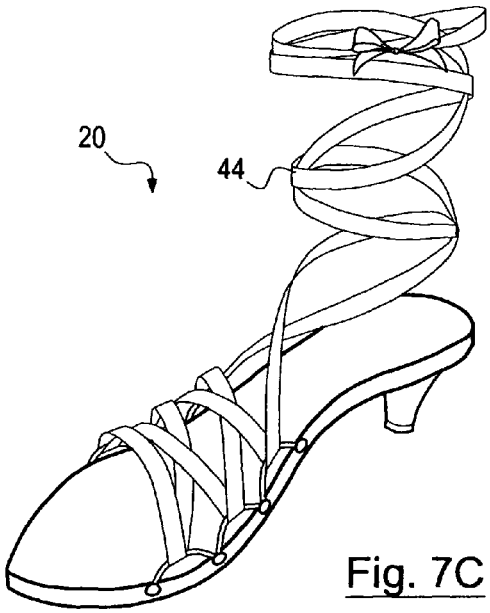

Referring to FIG. 1B (perspective view), a strap 34 is laced through the elastic bindings 28 to form the shoe upper and to secure the wearer's foot to the sole of the shoe 22. A common, well-known lacing method is illustrated: a crisscross pattern culminating with a bow and/or knot, as is typically employed with athletic shoes. To tie the straps in such a manner results in a slip-on or "mule" style shoe. It should be understood that the strap may be laced through the elastic bindings 28 in any of a wide variety of patterns per the preference of the wearer. Additionally, the strap 34 may be of any usable length and material per the preference of the wearer, and may be tied as firmly or loosely as preferred in order to create a custom fit FIGS. 7A, 7B, and 7C (all perspective views), illustrate three variations of the myriad ways the shoes may be tied onto the feet by the wearer. FIG. 7A shows a strap 40 laced through the elastic bindings as illustrated in FIG. 1B and described above, but the strap is tied behind the ankle as opposed tied at the front of the foot. FIG. 7B shows a three relatively short straps 42, which are coupled with corresponding loops formed in the elastic bindings 28. FIG. 7C shows a strap 44 of significant length so as to tie around the ankle and up the leg. It should be understood that these lacing methods are just a few examples of the virtually innumerable lacing methods, and thusly fits and aesthetic appearances of the shoe, that are an intrinsic aspect of the preferred embodiment of the present invention.

Description

Alternative Embodiments

Figure 8A:
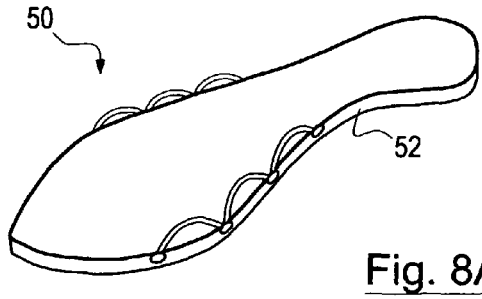
FIGS. 8A to 8C are perspective views of alternative embodiments of the sole member.
Figure 8B:
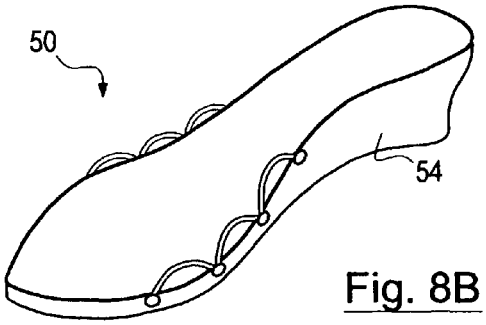
Figure 8C:
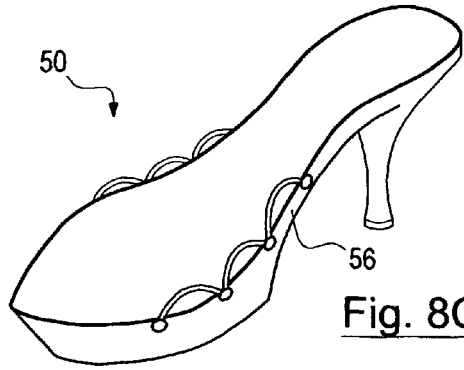

FIGS. 8A-8C; 9A-9C; and 10A-10C show alternative embodiments of the present invention. Alternative embodiments of the shoe system embodying the principle and concepts of the present invention and generally designated by the reference numeral 50 will be described.

FIGS. 8A-8C show examples of alternative shoe sole members. FIG. 8A shows an alternative embodiment of the present invention with a flat sole member 52. FIG. 8B shows an alternative embodiment of the present invention with a wedge heeled sole member 54. FIG. 8C shows an alternative embodiment of the present invention with a high heeled platform sole member 56.

Figure 9A:
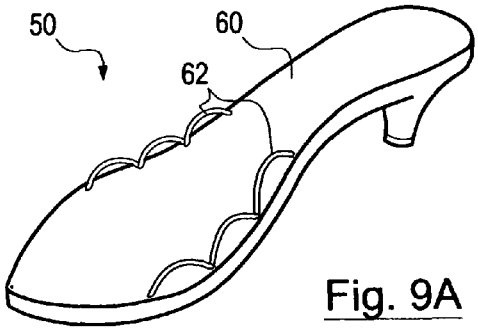
FIGS. 9A to 9C are perspective views of alternative embodiments of the attachment of the elastic bindings to the sole member.
Figure 9B:
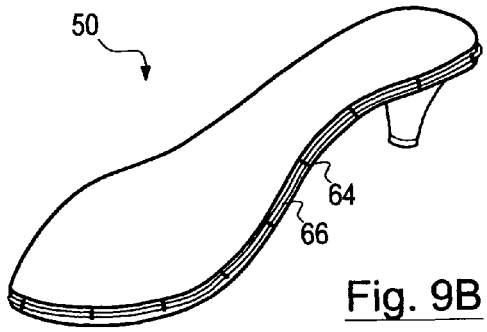
Figure 9C:
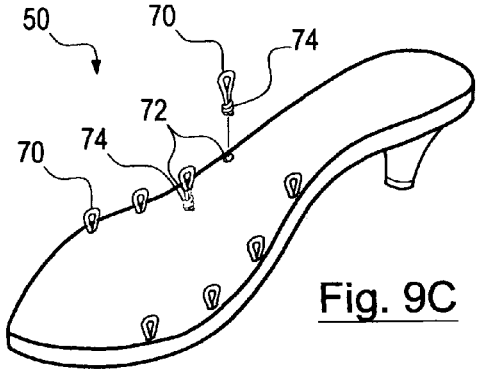

FIGS. 9A-9C show examples of alternative attachment methods of the elastic bindings. FIG. 9A shows an alternative embodiment of the present invention where the elastic bindings 62 are molded together with the sole member 60, resulting in a single binding/sole unit that alleviates the need to mechanically fasten the bindings to the sole member. FIG. 9B shows an alternative embodiment of the present invention where a long continuous elastic binding 66 runs along the outer perimeter of the sole member. The binding is affixed to the sole member with a number of staples 64, or other mounting devices, which attach the binding 66 to the sole member at regular intervals, such as every 1.5". FIG. 9C shows an alternative embodiment of the present invention where loops of elastic material 70 are formed by tying a knot or otherwise creating a sturdy, bulbous end 74 on the lower part of the loop. Holes 72 larger than the diameter of the elastic loop 70, but smaller than the diameter of the bulbous end 74, are created at regular intervals along the inner edge and outer edge of the perimeter of the sole member. The loops 70 are then threaded through the holes 72, creating a system for lacing the coupling strap of the present invention.

Figure 10A:
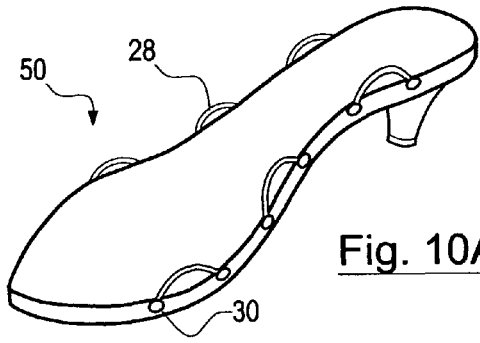
FIGS. 10A to 10C are perspective views of alternative embodiments of the arrangement of the elastic bindings on the sole member.
Figure 10B:
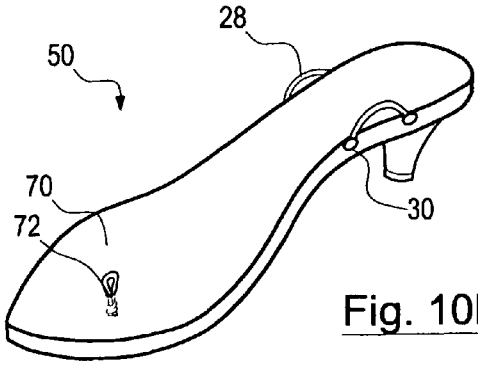
Figure 10C:
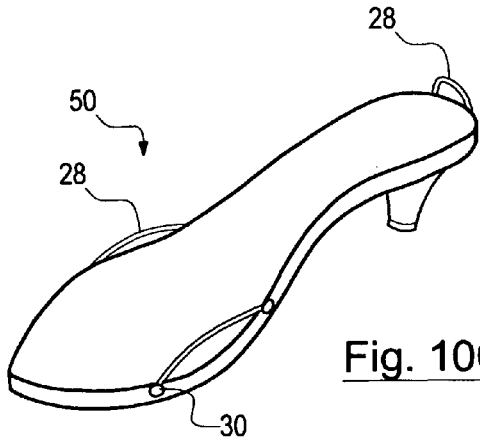

FIGS. 10A-10C show alternative arrangements of the elastic bindings. FIG. 10A shows several smaller sections of elastic bindings 28 tied in a series of loops/knots and attached with mounting studs 30. The bindings 28 and studs 30 are shown in an alternative arrangement from the preferred embodiment; this arrangement provides wider spacing between the bindings and provides bindings toward the ankle/rear of the foot. FIG. 10B shows elastic bindings 28 tied in loops/knots and attached with mounting studs 30, located toward the ankle/rear of the foot. An additional loop, attached in the method illustrated in FIG. 9C and in the accompanying description above, provided between the big toe and other toes creates a fit similar to a "thong" or "flip-flop" style shoe. FIG. 10C shows a longer length of elastic bindings 28 tied in loops/knots and attached with mounting studs 30. An additional binding 28, is attached at the back of the sole member in the same manner.

With respect to the above descriptions then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are to be encompassed by the present invention.

Therefore, the foregoing is considered as illustrative only of the principles of the invention. Further, since numerous modifications and changes will readily occur to those skilled in the art, it is not desired to limit the invention to the exact constructions and operations shown and described, and accordingly, all suitable modifications and equivalents may be resorted to, falling within the scope of the invention.

CONCLUSION, RAMIFICATIONS, AND SCOPE

Accordingly the reader will see that, according to the invention, I have provided a shoe with elastic bindings that allows the user to quickly and easily customize the fit and appearance of her footwear, and to efficiently and inexpensively match her attire without creating a financial or storage burden. Additionally, the shoe of the invention causes less environmental damage by reducing a need for a large shoe wardrobe, easily accommodates variations in foot shapes, provides an opportunity for consumers to essentially design their own shoe uppers, allows alternatives for those with personal preferences regarding materials in the upper composition, and utilizes straps that can be used for a variety of non-shoe-related purposes. Furthermore, the shoe system with elastic bindings has additional advantages in that:

- A wearer can employ any of a variety of commonly available materials to quickly and inexpensively create a new shoe upper as often as desired.
- A wearer can create virtually countless functional or aesthetic variations of her shoe style, such as a "mule"/slip-on style, an ankle tie, or laced up the leg.

A wearer can employ a nearly limitless variety of ribbons, laces, trims, tapes or other materials to create the upper of the shoe.

The connection between the interchangeable upper and sole is simple and obvious to an inexperienced user.

The physical connection between the interchangeable upper and sole is sturdy and dependable, yet flexible, providing a comfortable walking experience.

The upper is quickly and easily customized to an ideal fit for the wearer.

It is to be understood that the invention is not limited in its application to the details of the construction and to the arrangements of the components set forth in the description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention.

Thus the scope of the invention should be determined by the appended claims and their legal equivalents, rather than by the examples given.

I claim:

1. A sandal system for receiving user configurable uppers comprising:

a sole member having an upper surface configured to receive a user's foot in a longitudinal direction, a lower surface configured to contact a support surface, the sole member has a longitudinally forward region for supporting a forward portion of a user's foot, a heel region for supporting a heel portion of a user's foot;

an outer side wall extending between the lower surface and the upper surface of the sole member, the outer side wall terminates at the upper surface of the sole member in at least one area so as not to extend above the upper surface of the sole member in said at least one area;

at least one open side area adjacent to the upper surface where the open side area extends upward from the upper surface;

a plurality of elastic lacing loops connected to said sole member, each loop of said plurality of elastic lacing loops has a first end and an opposite second end, the plurality of elastic lacing loops comprises a first group of loops and a second group of loops, the first group of loops is spaced apart laterally across the sole member from the second group of loops;

the first group of loops is formed from a first continuous piece of material and the second group of loops is formed from a second continuous piece of material, the loops are formed by creating a predetermined number of connection points spaced apart along a length of each said respective continuous piece of material; a predetermined number of mounting studs, corresponding to the predetermined number of connection points, connect the loops to the sole member through the connection points; at least one connection point forms a valley between opposite rising portions of adjacent loops of each said respective continuous piece of material; the first continuous piece of material is separate from the second continuous piece of material;

the first or second end of at least one loop of each of said first and second groups of loops connects to the sole member at a common connection point with the first or second end of at least one immediately adjacent loop of the same group, said common connection point is one of the predetermined number of connection points;

at least one loop of said first group of loops and at least one loop of said second group of loops is a longitudinally extending loop; the first end of each longitudinally extending loop is connected to the sole member at a first connection point of the predetermined number of connection points, and the second end of each longitudinally extending loop is connected to the sole member at a second connection point of the predetermined number of connection points; the first connection point and the second connection point are arranged longitudinally with respect to one another and in relation to a longitudinal length of the sole member;

each loop of said plurality of elastic lacing loops has a round cross-section along an entire length between the first end and the second end;

at least one loop of said first group of loops and said second group of loops has an opening, said opening is orientated laterally in relation to the longitudinal length of the sole member;

said plurality of elastic lacing loops configured to stretch when pulled away from the sole member.

2. The sandal system of claim 1, wherein the said sole member has an intermediate region between said forward and heel regions for positioning under a central portion of a user's foot including a longitudinal arch of the user's foot; the elastic lacing loops being located in the forward and intermediate regions of said sole member.

3. The sandal system of claim 1, wherein said sole member has an intermediate region between said forward and heel regions for positioning under a central portion of a user's foot including a longitudinal arch of the user's foot; the plurality of elastic lacing loops being located in the forward and heel regions of said sole member.

4. The sandal system of claim 1, wherein the first group of loops and the second group of loops have an equal number of loops, the first group of loops spaced apart laterally across the sole member from the second group of loops a sufficient distance to receive said user's foot therebetween.

5. The sandal system of claim 1, wherein said elastic lacing loops are connected to the outer side wall.

6. The sandal system of claim 5, wherein the predetermined number of mounting studs comprise a first plurality of mounting studs and a second plurality of mounting studs; the outer side wall comprises a first lateral side wall portion and an opposite second lateral side wall portion; the first plurality of mounting studs connecting the first group of loops to the first lateral side wall portion through the connection points of the first continuous piece of material and the second plurality of mounting studs connecting the second group of loops to the second lateral side wall portion through the connection points of the second continuous piece of material.

7. The sandal system of claim 1, wherein at least one connection point along each of the first continuous piece of material and the second continuous piece of material is a knot.

8. The sandal system of claim 1, wherein each of the plurality of elastic lacing loops are substantially equal in size.

9. The sandal system of claim 1, wherein at least one connection point for the first continuous piece of material and the second continuous piece of material is an end of said respective continuous piece of material, each end is formed by creating a knot in the respective continuous piece of material.

10. The sandal system of claim 1, wherein two connection points for each of the first continuous piece of material and the second continuous piece of material are ends of said respective continuous pieces of material, each end has a terminating knot; the outer side wall has a plurality of recesses, the elastic lacing loops are connected at the outer side wall recesses and each terminating knot is received in a corresponding recess.

11. The sandal system of claim 1, wherein said elastic lacing loops include an outer casing of abrasion resistant material and an inner core having a plurality of elastic rubber cords.

12. The sandal system of claim 1, wherein the outer side wall comprises a first lateral side wall portion and an opposite second lateral side wall portion; the predetermined number of mounting studs comprises a first plurality of mounting studs and a second plurality of mounting studs, the first group of loops connected to the first lateral side wall portion with the first plurality of mounting studs and the second group of loops connected to the second lateral side wall portion with the second plurality of mounting studs.

13. The sandal system of claim 1, wherein the lower surface of the sole member comprises a raised heel.

14. The sandal system of claim 1, comprising a lacing strap having opposed ends configured to be laced in a configuration of said user's preference through said loops and across said user's foot to secure said user's foot to said upper surface of said sole member; said plurality of elastic lacing loops configured to stretch when pulled away from the sole member.

15. The sandal system of claim 14, wherein the lacing strap comprises the user configurable upper and is generally an open upper having a plurality of open areas and the lacing strap interrupts the open areas and defines one or more boundaries of one or more of said plurality of open areas.

16. The sandal system of claim 1, wherein said first and second ends of said at least one loop of said first group of loops and said second group of loops are attached to the sole member so as to orient said opening laterally with respect to the longitudinal length of the sole member.

17. A sandal for receiving interchangeable uppers comprising:

a sole member having an upper surface configured to receive a user's foot in a longitudinal direction and a lower surface configured to contact a support surface;

the sole member has a longitudinally forward region for supporting a forward portion of a user's foot, a heel region for supporting a heel portion of a user's foot;

an outer side wall extending between the lower surface and the upper surface of the sole member, the outer side wall terminates at the upper surface of the sole member in at least one area so as not to extend above the upper surface of the sole member in said at least one area;

a plurality of flexible loops operatively connected to said sole member, each loop of said plurality of flexible loops has a first end and an opposite second end;

the plurality of flexible loops comprises a first group of loops and a second group of loops, the first group of loops is spaced apart laterally across the sole member from the second group of loops a sufficient distance to receive a user's foot therebetween;

the first group of loops is formed from a first continuous piece of material and the second group of loops is formed from a second continuous piece of material, the loops are formed by creating a predetermined number of connection points spaced apart along a length of each said respective continuous piece of material; a predetermined number of mounting studs, corresponding to the predetermined number of connection points, connect the loops to the sole member through the connection points; at least one connection point forms a valley between opposite rising portions of adjacent loops of each said respective continuous piece of material; the first continuous piece of material is separate from the second continuous piece of material;

the first or second end of at least one loop of each of said first and second groups of loops connects to the sole member at a common connection point with the first or second end of at least one immediately adjacent loop of the same group, said common connection point is one of said predetermined number of connection points;

at least one loop of said first group of loops and at least one loop of said second group of loops is a longitudinally extending loop, each longitudinally extending loop has an opening and said first and second ends of the loop are attached to the sole member so as to orient said opening transverse to a longitudinal length of the sole member;

a substantially open perimeter that is adjacent to and extends laterally from the upper surface of the sole;

said plurality of flexible loops configured to stretch against the force of the user's foot when the loops are engaged by a strap laced over said foot and through the loops.

18. The sandal system of claim 17, wherein the first end of at least one loop of said first and second groups of loops is connected to the sole member at a first connection point of the predetermined number of connection points and the second end of said at least one loop of said first and second groups of loops is connected to the sole member at a second connection point of the predetermined number of connection points; the first connection point is spaced apart from the second connection point, said at least one loop is defined between the first end, the second end, and the sole member extending therebetween.

19. A sandal configured to receive user configurable uppers comprising:

a sole member having opposite heel and toe ends, a pair of opposite sides, upper and lower surfaces, and a perimeter side wall extending around a perimeter of said sole member and interposed between said upper and lower surfaces of said sole member;

the perimeter side wall terminates at the upper surface of the sole member so as not to extend above the upper surface of the sole member;

a plurality of expandable lace connecting members attached to said sole member, each member of said plurality of expandable lace connecting members has a first end and an opposite second end;

the plurality of expandable lace connecting members comprises a first group of expandable lace connecting members and a second group of expandable lace connecting members, the first group of expandable lace connecting members is spaced apart laterally across the sole member from the second group of expandable lace connecting members a sufficient distance to receive a user's foot therebetween;

the first group of lace connecting members is formed from a first continuous piece of material and the second group of lace connecting members is formed from a second continuous piece of material, the lace connecting members are formed by creating a predetermined number of connection points spaced apart along a length of each said respective continuous piece of material; a predetermined number of mounting studs, corresponding to the predetermined number of connection points, connect the lace connecting members to the sole member through the connection points; at least one connection point forms a valley between opposite rising portions of adjacent lace connecting members of each said respective continuous piece of material; the first continuous piece of material is separate from the second continuous piece of material;

the first or second end of each expandable lace connecting member of each of said first and second groups connects to the sole member at a common connection point with the first or second end of at least one immediately adjacent expandable lace connecting member of the same group, said common connection point is one of the predetermined number of connection points;

at least one expandable lace connecting member of said first group of expandable lace connecting members and at least one expandable lace connecting member of said second group of expandable lace connecting members is a longitudinally extending expandable lace connecting member; the first end of each longitudinally extending expandable lace connecting member is connected to the sole member at a first connection point of the predetermined number of connection points, and the second end of each longitudinally extending expandable lace connecting member is connected to the sole member at a second connection point of the predetermined number of connection points; the first connection point and the second connection point are arranged longitudinally with respect to one another and in relation to a longitudinal length of the sole member;

each longitudinally extending expandable lace connecting member has an opening and said first and second ends of the expandable lace connecting member are attached to the sole member so as to orient said opening transverse to the longitudinal length of the sole member;

a lacing strap configured to be laced in a configuration of said user's preference through the plurality of expandable lace connecting members, said lace connecting members configured to expand when engaged by the lacing strap laced over said foot and through the lace connecting members to provide a comfortable fit;

a foot receiving area bounded by the upper surface of the sole member, the expandable lace connecting members, and the lacing strap; the foot receiving area has open sides extending upward from the upper surface on each lateral side adjacent to the upper surface, the open sides are interrupted by the strap when the strap is engaged with the expandable lace connecting members over said foot;

each expandable lace connecting member of said plurality of expandable lace connecting members has a circular cross-section along an entire length between the first end and the second end.

* * * * *